US007032625B2

(12) United States Patent
Rydin

(10) Patent No.: US 7,032,625 B2
(45) Date of Patent: Apr. 25, 2006

(54) MULTI-LAYER PAPERMAKING FABRICS HAVING A SINGLE OR DOUBLE LAYER WEAVE OVER THE SEAM

(75) Inventor: Bjorn Rydin, Hörby (SE)

(73) Assignee: Albany International Corp., Albany, NY (US)

( * ) Notice: Subject to any disclaimer, the term of this patent is extended or adjusted under 35 U.S.C. 154(b) by 190 days.

(21) Appl. No.: 10/602,164

(22) Filed: Jun. 24, 2003

(65) Prior Publication Data

US 2004/0261884 A1 Dec. 30, 2004

(51) Int. Cl.
*D03D 41/00* (2006.01)

(52) U.S. Cl. ..... 139/383 A; 162/358.2

(58) Field of Classification Search ..... 139/383 AA, 139/383 A; 162/358.2
See application file for complete search history.

(56) References Cited

U.S. PATENT DOCUMENTS

| | | | | |
|---|---|---|---|---|
| 4,182,381 A | | 1/1980 | Gisbourne | 139/383 |
| 4,186,780 A | * | 2/1980 | Josef et al. | 139/383 AA |
| 4,601,785 A | | 7/1986 | Lilja et al. | 162/199 |
| 4,764,417 A | | 8/1988 | Gulya | 428/222 |
| 4,865,083 A | * | 9/1989 | Cunnane | 139/383 AA |
| 4,887,648 A | | 12/1989 | Cunnane | 139/383 |
| 5,188,884 A | | 2/1993 | Smith | 428/193 |
| 5,476,123 A | | 12/1995 | Rydin | 139/383 |
| 5,531,251 A | * | 7/1996 | Rydin | 139/383 AA |
| 5,799,884 A | | 9/1998 | Alavi | 241/27 |
| 6,079,454 A | | 6/2000 | Lee et al. | 139/383 |
| 6,194,331 B1 | | 2/2001 | Elkins | 442/225 |
| 6,213,164 B1 | | 4/2001 | Ostermayer et al. | 139/383 |
| 6,223,781 B1 | | 5/2001 | Yamada et al. | 139/383 |
| 6,267,150 B1 | | 7/2001 | Herring | 139/383 |
| 6,273,146 B1 | | 8/2001 | Herring | 139/383 |
| 6,273,147 B1 | | 8/2001 | Herring | 139/383 |
| 6,289,940 B1 | | 9/2001 | Herring | 139/383 |
| 6,302,155 B1 | * | 10/2001 | Rydin | 139/383 AA |
| 6,318,413 B1 | | 11/2001 | Herring | 139/383 |
| 6,349,749 B1 | | 2/2002 | Quigley | 139/383 |
| 6,378,566 B1 | | 4/2002 | Kornett | 139/383 |
| 6,508,278 B1 | * | 1/2003 | Kornett | 139/383 A |

FOREIGN PATENT DOCUMENTS

| | | |
|---|---|---|
| DE | 36 37 179 A | 5/1987 |
| EP | 0 287 229 A | 10/1988 |
| WO | WO 2004/029357 | 4/2004 |

* cited by examiner

*Primary Examiner*—John J. Calvert
*Assistant Examiner*—Robert H Muromoto
(74) *Attorney, Agent, or Firm*—Frommer Lawrence & Haug LLP; Ronald R. Santucci

(57) ABSTRACT

A multi-layer on-machine-seamable press fabric having a single or double layer weave over the seam loops where the warp ends are not normally woven with CD yarns. The CD yarns woven into the layer(s) over the seam loops provide the fabric with substantially similar characteristics—including caliper and water permeability—in the seam area as in the remainder of the fabric. Hence, the press fabric provides a solution to the problem of non-uniformity in the seam area, which often results in sheet marking.

15 Claims, 6 Drawing Sheets

MULTI-LAYER PAPERMAKING FABRICS HAVING A SINGLE OR DOUBLE LAYER WEAVE OVER THE SEAM

BACKGROUND OF THE INVENTION

1. Field of the Invention

The present invention relates to the papermaking arts. More specifically, the present invention relates to on-machine-seamable fabrics for the press section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates primarily to the fabrics used in the press section, generally known as press fabrics, but it may also find application in the fabrics used in the forming and dryer sections, as well as in those used as bases for polymer-coated paper industry process belts, such as, for example, long nip press belts.

Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are used in a wide variety of styles designed to meet the requirements of the paper machines on which they are installed for the paper grades being manufactured. Generally, they comprise a woven base fabric into which has been needled a batting of fine, non-woven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the paper machine clothing arts.

Woven fabrics take many different forms. For example, they may be woven endless, or flat woven and subsequently rendered into endless form with a seam. Alternatively, they may be produced by a process commonly known as modified endless weaving, wherein the widthwise edges of the base fabric are provided with seaming loops using the machine-direction (MD) yarns thereof. In this process, the MD yarns weave continuously back and forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are seamed together. To facilitate seaming, many current fabrics have seaming loops on the crosswise edges of the two ends of the fabric. The seaming loops themselves are often formed by the machine-direction (MD) yarns of the fabric. The seam is typically formed by bringing the two ends of the fabric press together, by interdigitating the seaming loops at the two ends of the fabric, and by directing a so-called pin, or pintle, through the passage defined by the interdigitated seaming loops to lock the two ends of the fabric together.

Further, the woven base fabrics may be laminated by placing one or more base fabrics on top of another base fabric in the endless loop form and needling a staple fiber batting through the base fabrics, thereby joining them to one another. Either base fabric may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine fabric manufacturers are required to produce press fabrics, and other paper machine fabrics, to the dimensions required to fit particular positions in the paper machines of their customers. Needless to say, this requirement makes it difficult to streamline the manufacturing process, as each press fabric must typically be made to order.

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. While many fabrics are endless, about half of those used in press sections of the paper machines today are of the on-machine-seamable type.

Installation of the fabric includes pulling the fabric body onto a machine and joining the fabric ends to form an endless belt.

A seam is generally a critical part of a seamed fabric, since uniform paper quality, low marking and excellent runnability of the fabric require a seam which is as similar as possible to the rest of the fabric in respect of properties such as thickness, structure, strength, permeability, etc . . . It is important that the seam region of any workable fabric behave under load and have the same permeability to water and to air as the rest of the fabric, thereby preventing periodic marking of the paper product being manufactured by the seam region. Despite the considerable technical obstacles presented by these seaming requirements, it is highly desirable to develop seamable fabrics, because of the comparative ease and safety with which they can be installed.

For example, changing a non-seamable press fabric in the press section of a papermaking machine typically requires a cantilevered machine design and movable rolls in order to slide the fabric into position through the side of the machine, whereas an on-machine-seamable fabric can be fed through the end of the machine. Hence, one advantage of using a seamable press fabric is a simplified fabric-change procedure which results in shorter standstill periods and thus higher production for the machine. In newly-produced machines the press-section construction can be simplified, which means cost savings when new press sections are to be installed. In addition, the press section may be made more compact and the space required around the press section may be considerably reduced.

Generally, the manufacture of an on-machine-seamable press fabric includes the attachment of a staple fiber batt (i.e. felt) to one or both sides of a woven base. The woven base preferably consists of at least two layers of interwoven machine-direction (MD) yarns and cross-machine direction (CD) yarns. The attachment of the batting may be effected by a process called needling (fiber locking) while the fabric is seamed in an endless loop form. Once the desired amount of staple fiber batt has been attached, the loop forming pin or pintle is removed from the seam to place the fabric into flat form for shipment and eventual installation on a paper machine. At this time, the staple fiber batt must be cut in the vicinity of the seam to completely separate the two ends of the press fabric from one another. Often, the staple fiber batt is cut in a manner that enables it to form a flap over the seaming loops when the press fabric is rejoined into endless form. In this way, the seam region is visibly similar to the rest of the paper-supporting side of the press fabric. This type of press fabric is taught in commonly assigned U.S. Pat. No. 4,601,785 to Lilja et al. which is hereby incorporated herein by reference.

FIG. 7 is a cross-sectional illustration which is obviously not drawn to scale, but rather is an enlargement of a typical multi-layer press fabric 1, as taught in U.S. Pat. No. 4,601,785, showing a flap of batting material over the seam area. The press fabric 1 typically has a woven fabric base 7. The fabric is given an endless form by providing its ends with loops 8 and 9 which in a manner known to those skilled in the art are arranged in an intermeshing relationship and locked in position by means of a pintle wire or connector 10 inserted through the loops 8, 9. On top of the base 7 an upper batt layer 11 and a bottom batt layer 12 are then attached by a needling operation. Behind the seam loops 8, 9, as seen in the intended direction of travel of the fabric in the machine, the upper batt 11 is cut through in the manner indicated in the figure and a piece 11*a* thereof is loosened in the area, across the seam and somewhat beyond the seam itself. It should be understood that for those fabrics also having a bottom batt layer 12, a corresponding cutting operation must be performed on the bottom batt. The pintle wire 10 may then be removed and the fabric placed in a flat form.

A press fabric prepared in this manner can then be carried around the rolls of the press section in the same manner as dryer fabrics in the dryer section and consequently it is no longer necessary to install the fabric through the side of the papermaking machine. When the press fabric has been fed through its path of travel in the press section, the loops are rejoined together with the aid of the pintle wire or connector. The installation of press fabrics in this manner is quicker, the operational stoppages briefer, and the work involved is significantly easier.

However, one problem with this type of press fabric is that some staple fiber batting must be removed from the seaming loops to facilitate the later passage of a pintle therethrough. The removal of this batting material changes the air and water permeability of the seam region in relation to the rest of the press fabric. This difference in water permeability, or flow resistance, is enough to cause sheet marking. Furthermore, the anchorage of the fibers with the batt in the seam area to the base is weakened.

Several approaches have been tried to address this problem. For example, in commonly assigned U.S. Pat. No. 6,194,331 to Elkins, a multi-layer base fabric is used wherein inner and outer base layers of the press fabric have separate offset seams each including additional flow-resistant material. Of course, this approach requires the use of two separate sets of seam loops which must be seamed.

Another approach is to have a multi-layer press fabric wherein the bottom layer is seamed and the MD yarns in the top layer continue over the seam and essentially become part of the seam flap. However, CD yarns cannot typically be woven in the seam area of this top layer. This makes it difficult to produce a fabric having a seam area with the same properties as the fabric body.

Accordingly, despite these efforts, a need still exists for an on-machine-seamable press fabric having a seam area which is uniform with the remainder of the fabric in order to prevent sheet marking in the produced paper products. The present invention uses another approach to solve this problem.

SUMMARY OF THE INVENTION

The present invention is a multi-layer on-machine-seamable press fabric having a single or double layer weave over the seam loops where the warp ends are not normally woven. The present invention provides a solution to the problem of press fabric non-uniformity in the seam area, which often results in sheet marking.

It is therefore an object of the invention to overcome the above mentioned problem in an on-machine-seamable press fabric.

The present invention is an on-machine-seamable fabric for use in the press section of a papermaking machine. The fabric has a multi-layer fabric base wherein each layer comprises interwoven machine direction (MD) yarns and cross-machine direction (CD) yarns. This multi-layer fabric base includes at least one top layer having both MD and CD yarns throughout and at least one seam layer beneath the top layer having seaming loops for seaming the fabric on the papermaking machine. The seaming loops allow the fabric to be on-machine-seamable. A staple fiber batt is attached to at least the top layer of the multi-layer fabric base. The staple fiber batt and top layer provide the fabric with substantially similar characteristics in the seam area above the seaming loops when seamed as the remainder of the fabric. These substantially similar characteristics include caliper and water permeability of the fabric, thereby reducing sheet marking from the seam area.

Other aspects of the present invention include that the fabric is preferably a triple layer fabric having a single top layer weave or a four layer fabric having a double top layer weave. Or, it can be a three layer weave wherein the top two layers of MD yarns form the seam loops. The seaming loops may be formed from the MD yarns of the at least one seam layer. The seaming loops are accessible through a flap cut through the staple fiber batt and top layer. The fabric is seamed into an endless loop by interdigitating the seaming loops and inserting a pintle therein. The CD yarns over the seam area of the top layer may be textured yarns or what is sometimes referred to as Circumflex yarns (yams interwoven with loops in the seam area, see e.g., U.S. Pat. Nos. 5,476,123 and 5,531,251) selected to impart desired characteristics to the seam area of the fabric. The staple fiber batt may be attached to the top layer by needling. A second staple fiber batt may be attached to the seam layer of the fabric base. At least some of the yarns may be one of polyamide, polyester, polybutylene terephthalate (PBT), or polyethylene naphthalate (PEN) yarns. Any of the yarns may have a circular cross-sectional shape, a rectangular cross-sectional shape or a non-round cross-sectional shape.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 1:
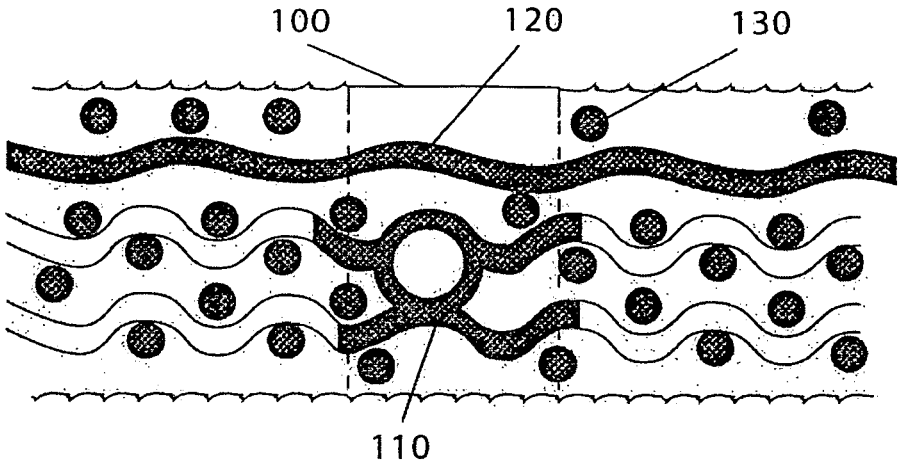
FIG. 1 (PRIOR ART)
FIG. 1 is a cross-sectional illustration of a typical multi-layer press fabric in the seam area.

FIG. 1 is a cross-sectional illustration of the seam area 100 for a typical multi layer press fabric. As shown, the MD ends of the two bottom layers have seaming loops which come together and form a seam 110 to place the fabric into an endless loop form. Note that the top layer comprising at least MD yarns 120 and CD yarns 130 has no CD yarns interwoven in the seam area 100 above the seam 110. In part, this is due to the difficulties in weaving CD yarns in this area. In addition, three and four layer seamed press fabrics often have denser top MD layer(s) with a higher number of yarns in the MD. This makes it difficult to produce a fabric having a seam area with the same properties as the fabric body. This lack of CD yarns typically results in a reduced caliper in this seam area when the fabric is under pressure in a press nip. Additionally, this region provides less batt anchorage which results in the flap area wearing out more quickly than the rest of the fabric and producing seam marking.

In other words, because there are normally no CD yarns woven with the MD yarns in the flap/seam area of the top layer(s), the fabric will have a slightly different caliper due to compaction and different air and water permeability. Differences in these characteristics often results in marking on the paper sheets being produced.

The present invention is a multi-layer press fabric (preferably 3 or 4 layers) having a single or double layer weave over the seam area where normally the warp ends are not woven. The press fabric consists of a woven fabric base having a batt needled thereto on one or both sides. The woven base preferably consists of at least two layers of machine-direction (MD) yarns and a system of cross-machine direction (CD) yarns interconnecting the MD yarns. The machine-direction ends of the woven base are joined together by a seam of a kind known in the art and that a flap of the needled-on batt(s) is arranged to cover the seam zone after the woven base ends have been joined together.

The invention involves weaving CD yarns in the flap area of the seam where ordinary warp yarns cannot be woven. One of the advantages inherent in the subject invention is that the seam, owing to the complete layer above the seam, imparts more uniform characteristics to the fabric across the seam area.

Figure 2:
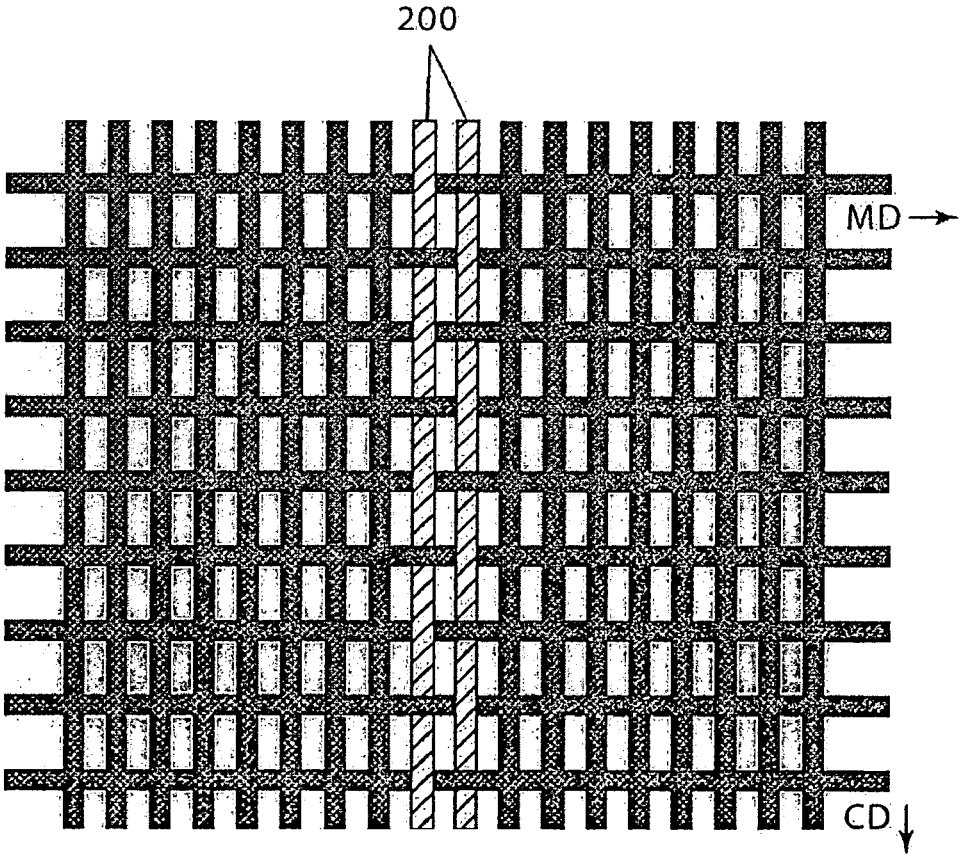
FIG. 2 is a top plan view of a multi-layer fabric base for a press fabric in accordance with the teachings of the present invention.

The preferred embodiments of the present invention will now be described by reference to the Figures. FIG. 2 is a top plan view of a multi-layer fabric base for a press fabric in accordance with the teachings of the present invention. As shown, the top layer is a plain weave pattern, although the invention is not limited as such. The lighter shaded CD yarns 200 are located directly above the seaming loops of the lower layers of the base. Note that these CD yarns 200, which are omitted during the weaving of typical fabrics, complete the top layer pattern in the seam area.

Also note, this fabric base is preferably woven such that the CD yarns are warp yarns and the MD yarns are weft yarns. Hence, CD yarns 200 represent extra warp yarns which together with the MD yarn, weave a single layer weave over the seam area, where the ordinary warp ends cannot be woven.

Figure 3A:
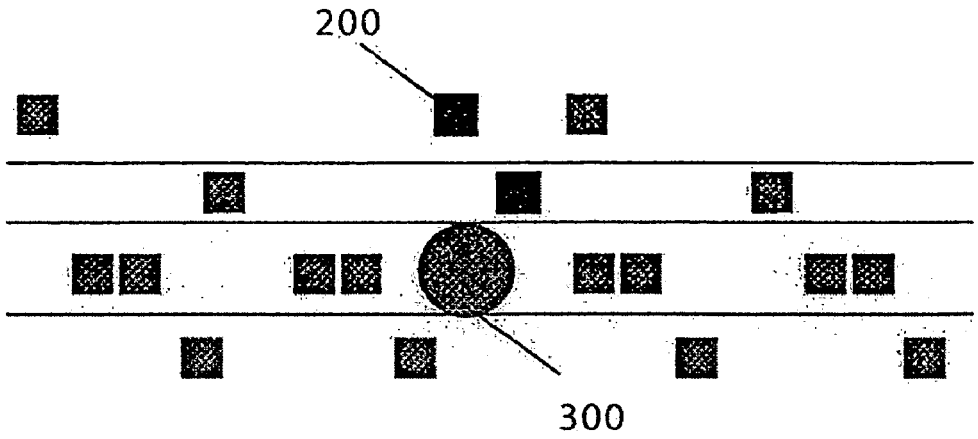
FIG. 3 is a schematic cross-sectional view of a multi-layer fabric base for a press fabric in accordance with the teachings of the present invention showing: a) a single layer weave and b) a double layer weave over the seam area.
Figure 3B:
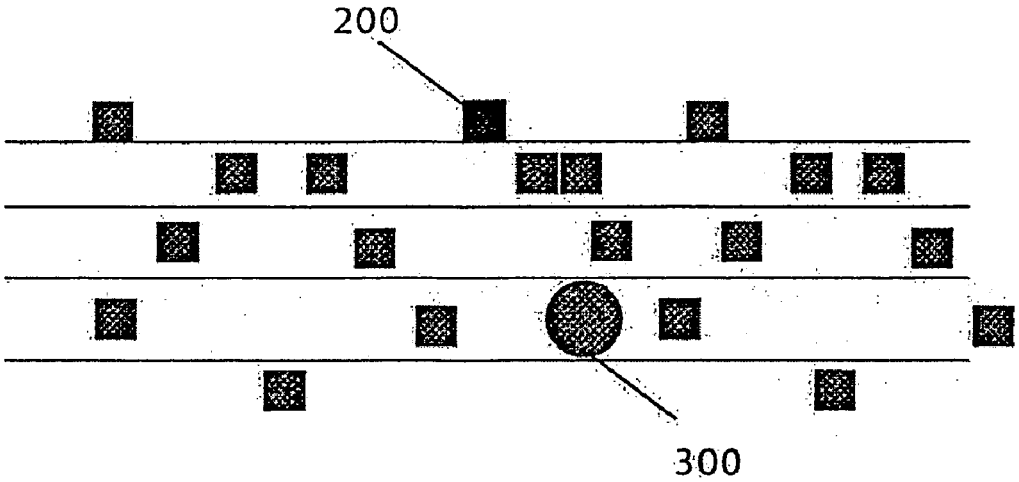

FIG. 3 is a schematic cross-sectional view of a multi-layer fabric (which may be the same as that shown in FIG. 2) in accordance with the teachings of the present invention showing: a) a single layer weave and b) a double layer weave over the seam area. As discussed in the context of this invention, the seam area extends laterally to at least each side of the seam 300. Note that in FIG. 3*a* the lighter shaded CD yarns 200 only weave with the single top layer, while the ordinary CD warp yarns weave in all three layers except over the seam. As indicated, FIG. 3*b* is an example of a 4-layer fabric having a double layer weave on top of the seam loops. Note, a modification to this embodiment is to have two (2) single layer weaves on top of the seam loops. Another embodiment is a double layer weave over a single layer weave wherein the top two layers of MD yarns (weft yarns) form the seam loops.

Figure 4:
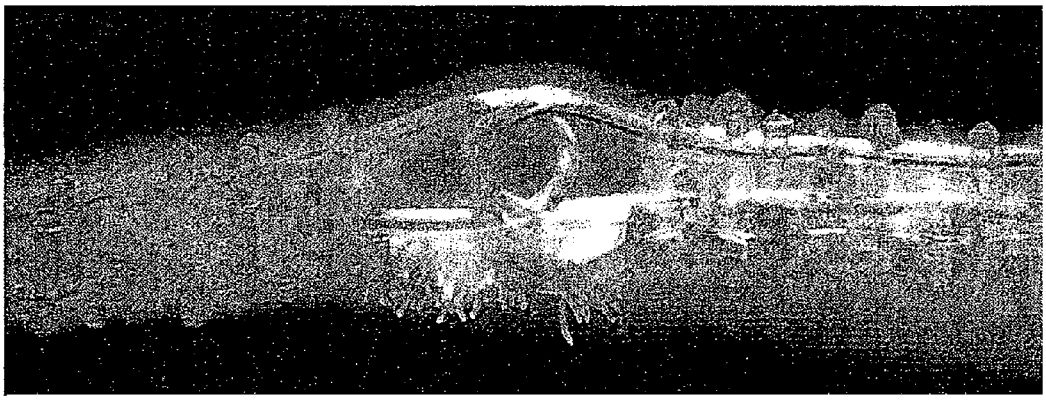
FIG. 4 is a cross-sectional view of an example multi-layer fabric in accordance with the teachings of the present invention
Figure 5:
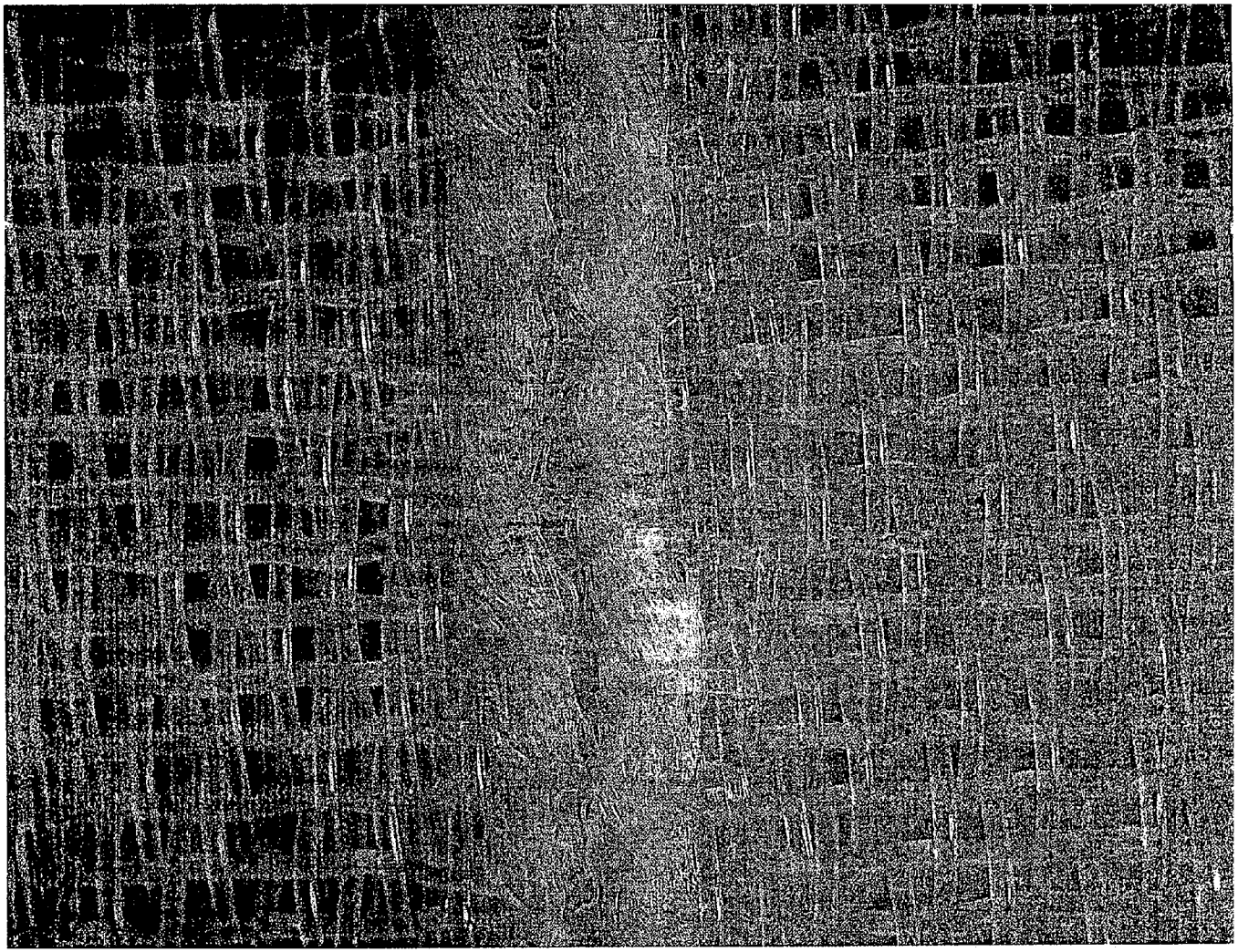
FIG. 5 is a top view of the fabric shown in FIG. 4.
Figure 6:
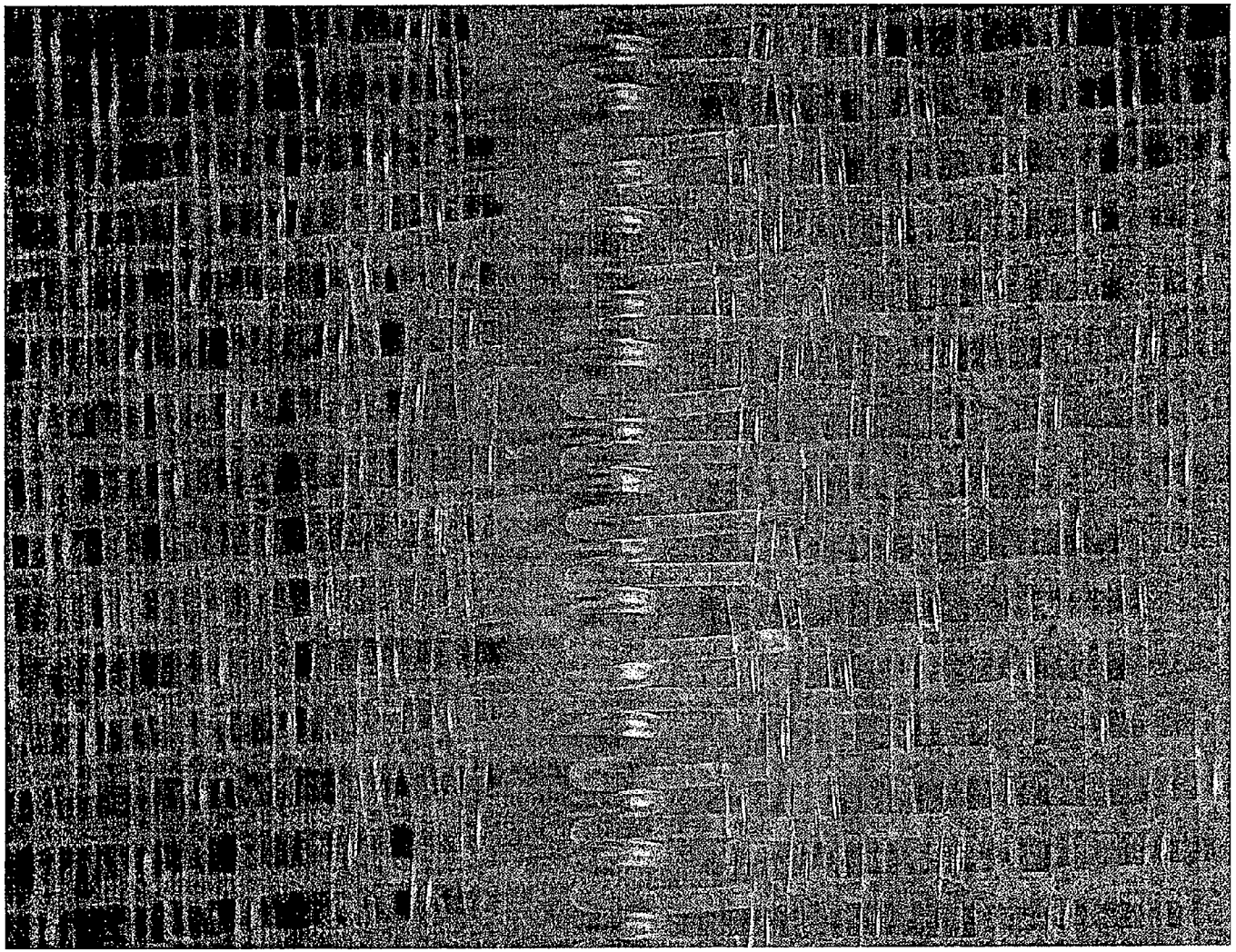
FIG. 6 is a bottom view of the fabric shown in FIG. 4.
Figure 7:
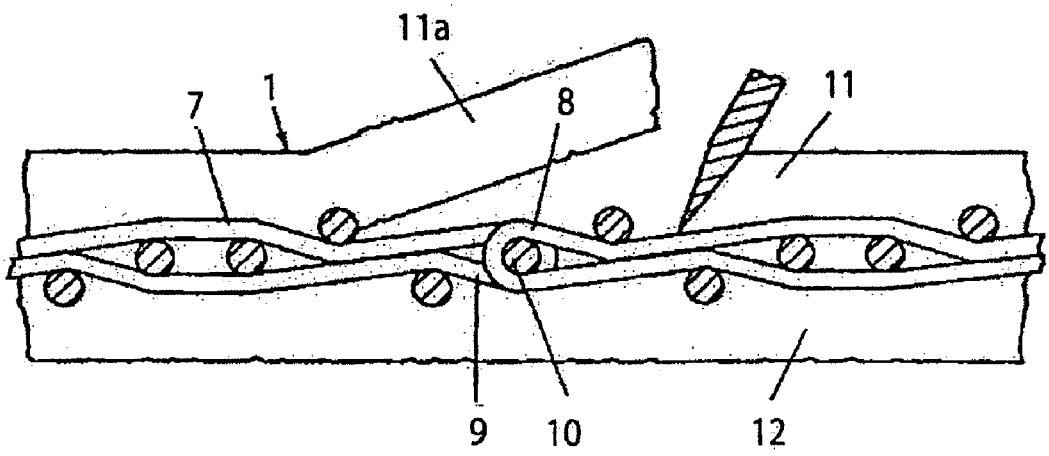
FIG. 7 (PRIOR ART)
FIG. 7 is a cross-sectional illustration of a typical multi-layer press fabric showing a flap of batting for access to the seam area.

FIGS. 4–6 show various views of an exemplary multi-layer fabric base fabricated for a press fabric in accordance with the teachings of the present invention without the staple fiber batt attached. In this example, the top layer has been woven with two texturized CD yarns inserted above the seam loops. These CD yarns provide a more uniform weave for the needled batting to bind to when cutting through the top layer to form the flap. These CD yarns also result in a better pressure distribution over the seam area. FIG. 4 is a cross-sectional view of the exemplary multi-layer fabric base in the area of the seam. Note the interdigitated seam loops, shown without a pintle inserted, connecting the MD ends of the lower two layers together. FIG. 5 is a top view and FIG. 6 is a bottom view of the fabric shown in FIG. 4. This exemplary fabric is ready for a pintle to be inserted into the interdigitated seam loops at which point the staple fiber batting may be attached.

If necessary, additional CD yarns can be inserted in the seam area to produce any desired fabric properties or required caliper. For example, it may be desirable to insert another yarn as a Circumflex yarn as aforementioned to further reduce seam wear, marking and noise. This Circumflex yarn is optional, but would be inserted or woven in the same manner to further improve the seamed product. Any weave pattern to add in additional CD yarns can be employed including weaves like those taught in U.S. Pat. No. 6,378,566, the teachings of which are incorporated herein by reference.

Furthermore, it is envisioned that the weave pattern in the seam area of the top fabric, whether it be single layer or double layer, can be different from that of the main body of the topside fabric weave in order to accomplish the desired effect of weaving in additional CD yarns. A concept for this is taught in U.S. Pat. No. 6,508,278, which is incorporated herein by reference.

The present fabric base may be woven from monofilament, plied monofilament or multifilament yarns preferably of polyester, polyamide, or other polymer such as polybutylene terephthalate (PBT) or polyethylene naphthalate (PEN). The yarns which form the seaming loops are preferably monofilament yarns which may be single or ply/twisted. Multifilament threads and spun yarns may also be used but when they are they may be made rigid through chemical treatment. Any combination of polymers for any of the yarns can be used as identified by one of ordinary skill in the art. The CD and MD yarns may have a circular cross-sectional shape with one or more different diameters. Further, in addition to a circular cross-sectional shape, one or more of the yarns may have other cross-sectional shapes such as a rectangular cross-sectional shape or a non-round cross-sectional shape.

Modifications to the above would be obvious to those of ordinary skill in the art, but would not bring the invention so modified beyond the scope of the present invention. The claims to follow should be construed to cover such situations.

What is claimed is:

1. An on-machine-seamable fabric for use in the press section of a papermaking machine, comprising:

a multi-layer fabric base wherein each layer comprises interwoven machine direction (MD) yarns and cross-machine direction (CD) yarns; the multi-layer fabric base including:

at least one seam layer beneath the top layer having seaming loops for seaming the fabric on the papermaking machine, thereby making the fabric on-machine-seamable; and wherein in said at least one top layer, at least one extra CD yarn is woven over the seaming loops; and wherein at least one top layer having both MD and CD yarns woven over the seaming loops.

2. The on-machine-seamable fabric of claim 1 which includes a staple fiber batt attached to the top layer of said multi-layer fabric base; the staple fiber batt and top layer providing the fabric with substantially similar characteristics in a seam area above the seaming loops when seamed as the remainder of the fabric.

3. The on-machine-seamable fabric of claim 1, wherein the substantially similar characteristics include caliper and water permeability of the fabric, thereby reducing sheet marking from the seam area.

4. The on-machine-seamable fabric of claim 1, wherein the multi-layer fabric base is a triple layer fabric having a single top layer weave and said at least one extra CD yarn is woven only in said single top layer weave.

5. The on-machine-seamable fabric of claim 1, wherein the multi-layer fabric base is a four layer fabric having a double top layer weave or two single layer weaves and said at least one extra CD yarn is woven only in said double top layer weave or said two single layer weaves.

6. The on-machine-seamable fabric of claim 1, wherein the seaming loops are formed from the MD yarns of the at least one seam layer.

7. The on-machine-seamable fabric of claim 1, wherein the fabric is seamed into an endless loop by interdigitating the seaming loops and inserting a pintle therein.

8. The on-machine-seamable fabric of claim 1, wherein the seaming loops are accessible through a flap cut through the staple fiber batt and top layer.

9. The on-machine-seamable fabric of claim 1, wherein said at least one extra CD yarns is texturized yarns selected to impart desired characteristics to the seam area of the fabric.

10. The on-machine-seamable fabric of claim 1, wherein the staple fiber batt is attached to the top layer by needling.

11. The on-machine-seamable fabric of claim 1, further comprising a second staple fiber batt attached to the seam layer of the fabric base.

12. The on-machine-seamable fabric of claim 1, wherein at least some of the yarns are polyarnide, polyester, polybutylene terephthalate (PBT), or polyethylene naphthalate (PEN) yarns.

13. The on-machine-seamable fabric of claim 1, wherein any of the yarns have a circular cross-sectional shape, a rectangular cross-sectional shape or a non-round cross-sectional shape.

14. The on-machine seamable fabric of claim 1 which includes staple fiber batt attached to a bottom layer of said fabric.

15. An on-machine-seamable fabric for use in the press section of a papermaking machine, comprising:

a multi-layer fabric base wherein each layer comprises interwoven machine direction (MD) yarns and cross-machine direction (CD) yarns; the multi-layer fabric base including:

at least one top layer having both MD and CD yarns woven throughout;

at least one seam layer beneath the top layer having seaming loops creating a seam for seaming the fabric on the papermaking machine, thereby making the fabric on-machine-seamable; and wherein said MD and said CD yarns in said at least one top layer are included in a flap extending across the seam.

* * * * *